US007036855B2

(12) United States Patent
Lin et al.

(10) Patent No.: US 7,036,855 B2
(45) Date of Patent: May 2, 2006

(54) OUTSIDE RELEASE HANDLE

(75) Inventors: Jih Cheng Lin, Farmington Hills, MI (US); Dennis John Buening, Northville, MI (US); Radoslav Bokun, Windsor (CA)

(73) Assignee: Intier Automotive Closures Inc., Newmarket (CA)

( * ) Notice: Subject to any disclaimer, the term of this patent is extended or adjusted under 35 U.S.C. 154(b) by 143 days.

(21) Appl. No.: 10/683,145

(22) Filed: Oct. 10, 2003

(65) Prior Publication Data

US 2004/0113439 A1 Jun. 17, 2004

Related U.S. Application Data

(60) Provisional application No. 60/417,619, filed on Oct. 10, 2002.

(51) Int. Cl.
*E05C 3/06* (2006.01)

(52) U.S. Cl. ..... 292/216; 292/336.3; 292/DIG. 23; 292/DIG. 27; 292/DIG. 62; 70/210; 70/DIG. 42

(58) Field of Classification Search ..... 292/216, 292/336.3, DIG. 62, 169.12, 169.14, DIG. 23, 292/DIG. 27, DIG. 31; 70/208, 210, 224, 70/DIG. 42
See application file for complete search history.

(56) References Cited

U.S. PATENT DOCUMENTS 2,143,965 A 1/1939 Voorhees
2,942,451 A * 6/1960 Windmassinger ..... 70/150
3,069,193 A * 12/1962 Kirk ..... 292/144
3,233,931 A * 2/1966 Peras ..... 292/123
3,993,338 A * 11/1976 Cherbourg et al. ..... 292/336.3
4,196,925 A * 4/1980 Torii ..... 292/216
4,389,061 A * 6/1983 Foshee ..... 292/169.14
4,508,379 A * 4/1985 Mochida ..... 292/336.3
4,773,683 A * 9/1988 Nakamura ..... 292/216
4,889,373 A 12/1989 Ward et al.
4,929,007 A 5/1990 Bartczak et al.
5,077,992 A * 1/1992 Su ..... 70/107
5,123,687 A 6/1992 Pfieffer et al.
5,511,838 A * 4/1996 Baughman et al. ..... 292/336.3
5,613,717 A 3/1997 Ha
5,681,068 A 10/1997 Kleefeldt et al.
5,715,713 A * 2/1998 Aubry et al. ..... 70/277
5,820,175 A * 10/1998 Clavin ..... 292/165
6,045,168 A * 4/2000 Johnson et al. ..... 292/216

(Continued)

*Primary Examiner*—Brian E. Glessner
*Assistant Examiner*—Carlos Lugo
(74) *Attorney, Agent, or Firm*—Clark Hill PLC

(57) ABSTRACT

A handle assembly selectively releases a door latch (28) of a door. The handle assembly has a housing (22) and an actuator such as a key cylinder (24) secured to the housing. The key cylinder (24) has a bell crank (124) rotatable relative to the housing between a neutral position to a locking position upon rotation in a locking sense and between a neutral position and an unlocking position upon rotation in an unlocking sense, opposite the locking sense. A handle (30) is pivotally mounted to the housing. A pull lever (46) is pivotally mounted to the housing and connects to the door latch (28). A link (42) has one end (44) pivotally connected to the pull lever (46) and an opposite end (40) slidingly connected to the bell crank (124). The pull lever (46) slidingly engages the handle (30) between a lock position wherein the pull lever (46) slides relative to the handle (30) and an unlocked position wherein the pull lever (46) is coupled to the handle (30) and handle movement is translated to the pull lever.

5 Claims, 4 Drawing Sheets

U.S. PATENT DOCUMENTS 6,079,757 A * 6/2000 Aubry ..... 292/201
6,415,636 B1 * 7/2002 Fukumoto et al. ..... 70/208
6,443,506 B1 * 9/2002 Su ..... 292/244
6,490,895 B1 12/2002 Weinerman et al.
6,609,737 B1 * 8/2003 Fisher ..... 292/216
2005/0146147 A1 * 7/2005 Niskanen et al. ..... 292/336.3

* cited by examiner

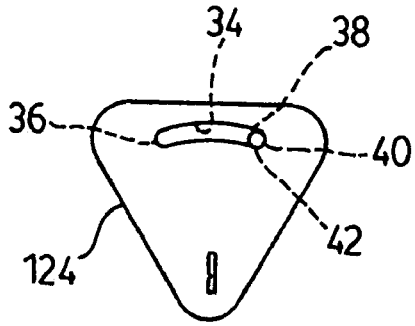
FIG. 5.
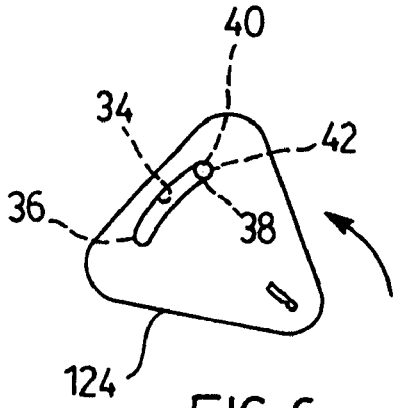
FIG. 6.
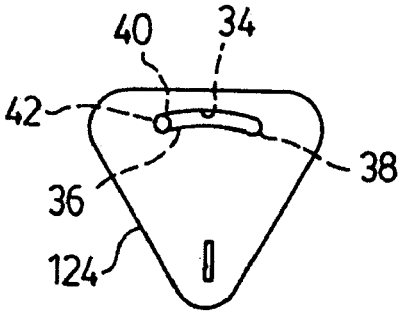
FIG. 7.
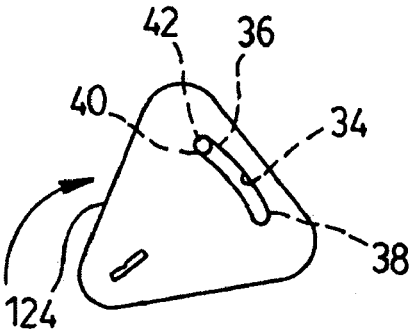
FIG. 8.
FIG. 9.
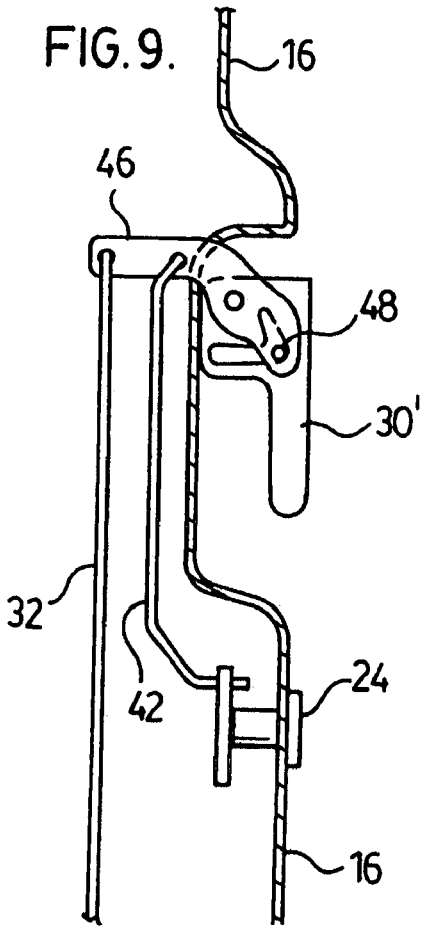

OUTSIDE RELEASE HANDLE

This appln. claims the benefit of 60/417,619 filed on Oct. 10, 2002.

FIELD OF THE INVENTION

The invention relates to a handle assembly for a door of a motor vehicle. More particularly, the invention relates to a handle assembly having a single connection to a door latch.

DESCRIPTION OF THE RELATED ART

A handle assembly positioned along an outer panel of a door of a motor vehicle is utilized by individuals to open the door and enter the motor vehicle. The handle assembly commonly includes a key cylinder, which is rotated to lock and unlock a door latch, and a handle, which is pulled to release the door latch and allow opening of the door. Multiple connections, typically cables and/or rods, extend between the handle assembly and the door latch, which is positioned within an inner cavity of the door. One connection extends from the key cylinder to the door latch and a second connection extends from the handle to the door latch. This use of multiple connections increases the chance of interference with other components housed within the inner cavity, which can result in the improper operation of the handle assembly and/or one of the other components. In addition, the use of multiple connections requires additional assembly steps and increases costs.

SUMMARY OF THE INVENTION

According to one aspect of the invention, there is provided a handle assembly that selectively releases a door latch of a door. A handle is pivotally mounted to the door. A pull lever, which is connected to the door latch, is also pivotally mounted to the door. An actuator provides an output selectively moveable between a neutral position to a locking position and between a neutral position and an unlocking position. In the preferred embodiment, the actuator is provisioned by a key cylinder which has a bell crank that is rotatable relative to the door. A linkage, such as a rod or cable, kinematically connects the pull lever with the output of the actuator. The pull lever slidingly engages the handle between a lock position wherein the handle is uncoupled from and slides relative to the pull lever and an unlocked position wherein the pull lever is coupled to the handle and handle movement is translated to the pull lever. In the preferred embodiment, the handle has a pin and the pull lever has a slot having first and second legs for receiving the pin. When the pin is disposed in the first leg, the handle is coupled to the pull lever, and when the pin is disposed in the second leg the handle is uncoupled from the pull lever.

According to another aspect of the invention a handle assembly is provided for selectively releasing a door latch of a door. The handle assembly has a housing and a key cylinder secured to the housing. The key cylinder has a bell crank rotatable relative to the housing between a neutral position to a locking position upon rotation in a locking sense and between a neutral position and an unlocking position upon rotation in an unlocking sense, opposite the locking sense. A handle is pivotally mounted to the housing. A pull lever is pivotally mounted to the housing. A link has one end pivotally connected to the pull lever and an opposite end slidingly connected to the bell crank. The pull lever slidingly engages the handle between a lock position wherein the pull lever slides relative to the handle and an unlocked position wherein the pull lever is coupled to the handle and handle movement is translated to the pull lever.

BRIEF DESCRIPTION OF THE DRAWINGS

Advantages of the invention will be readily appreciated as the same becomes better understood by reference to the following detailed description when considered in connection with the accompanying drawings wherein:

FIG. 5 is an isolated, side view of a key cylinder of one embodiment of the invention in a neutral position and a link member at a release end of a slot;

FIG. 6 is an isolated, side view of the key cylinder of one embodiment of the invention being rotated in a counter-clockwise direction;

FIG. 7 is an isolated, side view of the key cylinder of one embodiment of the invention in the neutral position and the link member at a lock end of the slot;

FIG. 8 is an isolated, side view of the key cylinder of one embodiment of the invention being rotated in a clockwise direction;

FIG. 9 is a side view of an alternative embodiment of the invention; and

DETAILED DESCRIPTION OF THE PREFERRED EMBODIMENT

Figure 1:
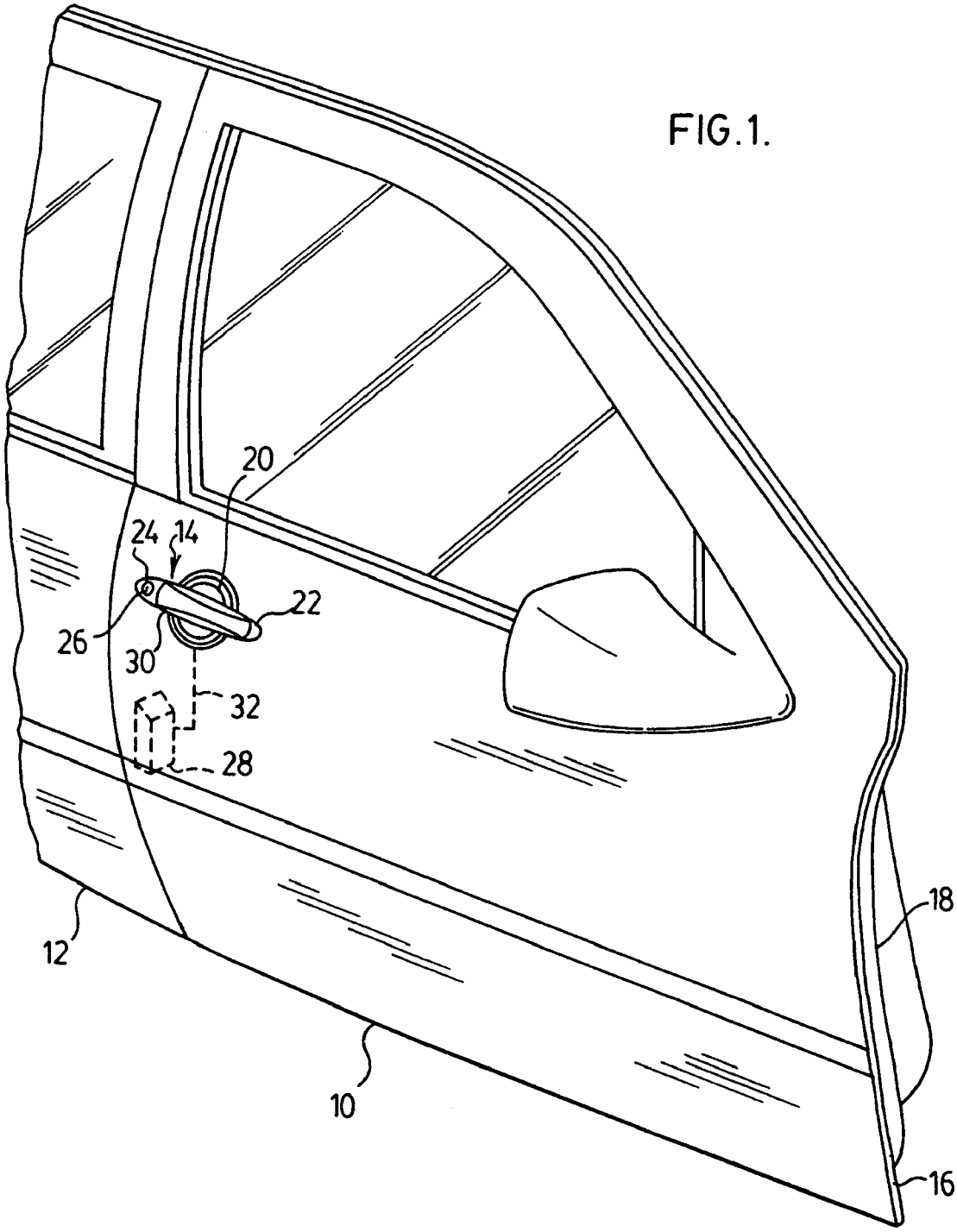
FIG. 1 is a side view, partially cut away, of a door of a motor vehicle and a handle assembly of one embodiment of the invention.

Referring to the Figures, a handle assembly for a door 10 of a motor vehicle 12 is generally shown at 14. The door 10 includes an outer panel 16 and an inner structure 18. The outer panel 16 defines a handle aperture or recess 20 therealong. A housing 22 of the handle assembly 14 extends through the handle aperture 20 and is fixedly secured to the inner structure 18.

The handle assembly 14 includes a key cylinder 24 fixedly secured to the housing 22. The key cylinder 24, which includes a keyhole 26, extends through the outer panel 16 so that the keyhole 26 is available for receiving a key (not shown). The key rotates the key cylinder 24 relative to the housing 22, and such rotation of the key cylinder 24 locks and unlocks the door latch 28. The mechanism used to translate the rotation of the key cylinder 24 into the change of locking state for the door latch 28 will be discussed in greater detail subsequently.

The handle assembly 14 also includes a handle 30 pivotally secured to the housing 22 and disposed adjacent the key cylinder 24. A connector rod 32 operatively extends between the handle 30 and the door latch 28. The connector rod 32 translates manual releasing movement of the handle 30 to the latch to thereby release the door latch 28 to open the door 10.

The door 10 may only be opened, however, when the door latch 28 is unlocked and released. From outside of the motor vehicle 12, the key cylinder 24 controls locking and unlocking of the door latch 28 whereas the handle 30 controls releasing of the door latch 28.

Figure 2:
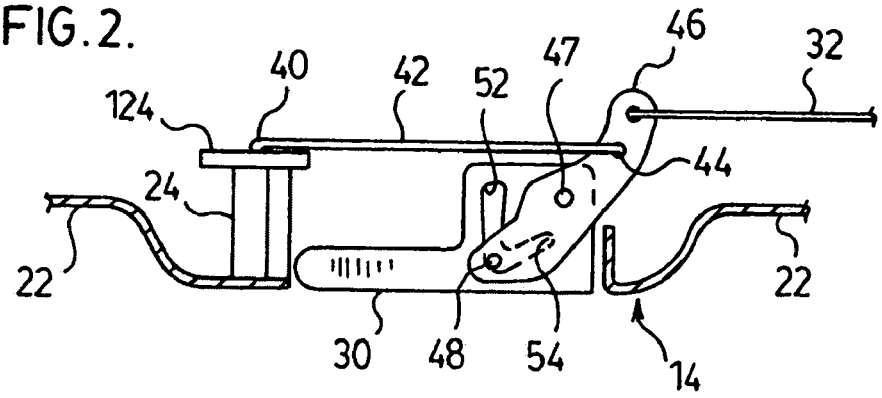
FIG. 2 is a top view of one embodiment of the invention with a pull lever in a lock position.

Referring to FIGS. 5 though 8, the key cylinder 24 includes a bell crank 124 that is mounted for rotation with the keyed shaft of the key cylinder 24. Bell crank 124 has a sector shape. Bell crank 124 is fixedly mounted to the keyed shaft of the key cylinder 24 at a point near the apex of the sector shape. Bell crank 124 has an arcuate slot 34 having a lock end 36 and a release end 38. A swaged end 40 of link 42, which extends between the key cylinder 24 and the handle 30 (as seen best in FIGS. 2–4), is fitted within the slot 34 in a sliding fit. The arcuate slot 34 provides a "lost motion" connection between the key cylinder and the handle.

Upon insertion of the key, the key cylinder 24 is rotated in either the clockwise direction or the counterclockwise direction. It will appreciated by those skilled in the art, however, that inputs other than the key may be utilized. For example, an electronic key fob that is remote from the door 10 or a combination lock system positioned along the housing 22 may be used in combination with an electric actuator to initiate rotation of the key cylinder 24.

In the embodiment shown, rotation of the key cylinder 24 and bell crank 124 out of a neutral position (FIG. 5) in the counterclockwise direction will cause the link 42 to move from the release end 38 to the lock end 36 (FIG. 7). Further rotation moves the link 42 in a locking direction. This will cause the link 42 to lock the door latch 28. Once the key cylinder 24 has rotated a sufficient amount to move the link 42, a spring or other biasing device returns the bell crank 124 to the neutral position (FIG. 7).

When the key cylinder 24 and bell crank 124 is rotated in the clockwise direction (FIG. 8), the link 42 will move from the lock end 36 to the release end 38. Further rotation moves the link 42 in an unlocking direction. This will cause the link 42 to unlock the door latch 28. Once the key cylinder 24 has rotated a sufficient amount to move the link 42, the biasing device will return the key cylinder 24 again to the neutral position (FIG. 5).

Returning attention to FIGS. 2 through 4, a second end 44 of the link 42 is pivotally secured to a pull lever 46. The pull lever 46 is pivotally mounted to the housing or door at pivot 47. A first end of the pull lever 46 has a pin 48 extending upwardly therefrom. On the opposite side of the pivot, the pull lever 46 has two apertures for receiving link 42 and rod 32.

Figure 3:
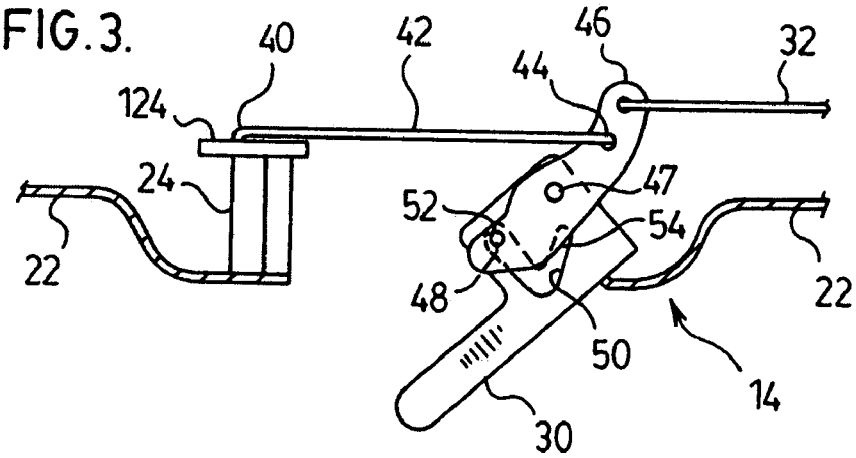
FIG. 3 is a top view of one embodiment of the invention with a handle being pulled while the pull lever is in the lock position.
Figure 4:
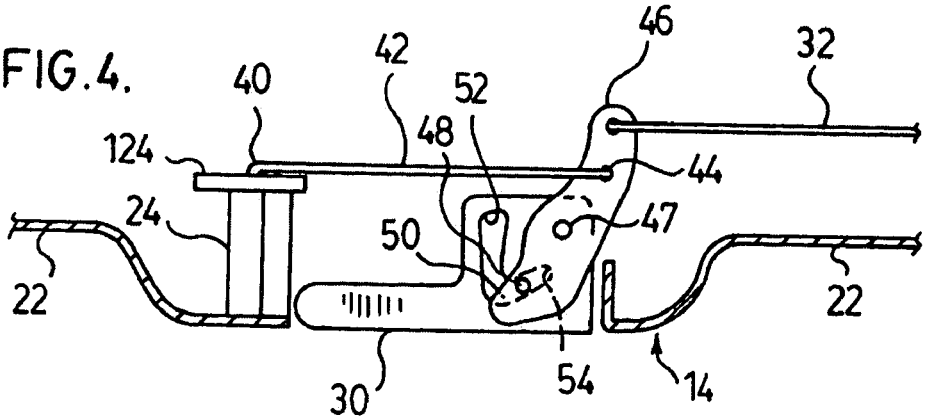
FIG. 4 is a top view of one embodiment of the invention with the pull lever in an unlock position.

Handle 30 has L-shaped slot 50 extending about pivot 47, located in the base thereof. The pin 48 is received within slot 50 securing the pull lever 46 to the handle 30. The slot 50 has two legs: a lever uncoupling leg 52 and a lever coupling leg 54. The movement of the link 42 between the lock and unlock positions causes the pull lever 46 to pivot, which, in turn, causes the pin 48 to travel between the lever uncoupling leg 52 and lever coupling leg 54 of the slot 50, moving the pull lever 46 between a lock position (FIGS. 2 and 3) and an unlock position (FIG. 4).

The connector rod 32 extends from the pull lever 46 and the handle 30 to the door latch 28.

When the pull lever 46 is in its lock position, i.e. when the bell crank 124 is moved to the locking direction, pin 48 will be in leg 52 of the slot 50, uncoupling the pull lever 46 from the handle 30. Pulling on the handle 30 will not effect movement of the pull lever 46 to effect release the door latch 28, even though the handle 30 will still be able to pivot relative to the housing 22 (FIG. 3). Instead, pin 48 will travel along the uncoupled leg 52 of slot 50 relative to the handle 30 in a "lost motion" fashion.

When the key cylinder is moved to its unlock position (FIG. 4), the bell crank moves the link 42 in an unlocking direction, moving the pin 48 to the leg 54 of slot 50, coupling the handle to the pull lever. Pin 48 is not able to slide relative to the handle 30 and thus provides a positive connection between the handle 30 and the pull lever 46. Pivoting of the handle 30 relative to the housing 22 pivots the pull lever 46 to urge the connector rod 32 to effect release of the door latch 28 and open the door 10.

Figure 10:
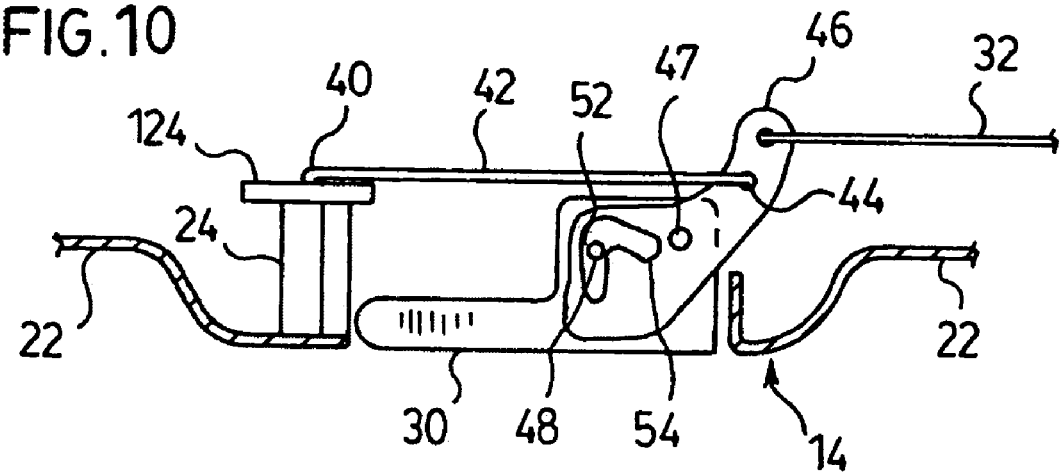
FIG. 10 is a top view of another alternative embodiment of the invention with a slot located on the pull lever and a pin located on the handle.

The invention has been described in an illustrative manner. It is to be understood that the terminology which has been used is intended to be in the nature of words of description rather than of limitation. Many modifications and variations of the invention are possible in light of the above teachings. For example, in alternative embodiments a paddle style handle may be employed as exemplified in FIG. 9. As shown in this drawing, key cylinder 24 is mounted below (or alternatively, above) a "paddle" handle 30' which pivots upwards relative to door 16. The key cylinder 24 is mounted to the door 16 in this embodiment. Other than being re-orientated in the vehicle, this embodiment operates in the same manner as the preferred embodiment. FIG. 10 shows another alternative embodiment in which the slot 50 is located on pull lever 46 and the pin 48 is located on handle 30. Other variations and modifications may be made to the preferred embodiment without departing from the spirit of the invention.

What is claimed is:

1. A handle assembly for selectively releasing a door latch of a door, said handle assembly comprising:

a handle pivotally mounted to said door;

a pull lever pivotally mounted to said door and connectable to said door latch;

a pin extending from one of said handle and said pull lever;

a two-legged slot on the other of said handle and said pull lever, said two-legged slot receiving said pin;

an actuator having an output selectively moveable between a neutral position to a locking position and between a neutral position and an unlocking position; and a linkage kinematically coupling said pull lever with said actuator output;

wherein said pull lever slidingly engages said handle between a lock position wherein said pin is located in a first leg of said two-legged slot, decoupling said handle from said pull lever, and an unlock position wherein said pin is located in a second leg of said two-legged slot, thereby coupling said handle to said pull lever and translating handle movement to said pull lever.

2. A handle assembly according to claim 1, wherein said actuator is a key cylinder secured to said housing or said door, said key cylinder having a bell crank rotatable relative to said housing or said door, said bell crank moveable between said neutral position to said locking position upon rotation in a locking sense and between said neutral position and said unlocking position upon rotation in an unlocking sense, opposite said locking sense.

3. A handle assembly for selectively releasing a door latch of a door, said handle assembly comprising:

a housing mounted to said door;

a key cylinder secured to said housing or said door, said key cylinder having a bell crank rotatable relative to said housing or said door, said bell crank moveable between a neutral position to a locking position upon rotation in a locking sense and between a neutral position and an unlocking position upon rotation in an unlocking sense, opposite said locking sense;

a handle pivotally mounted to said housing or said door, said handle having an L-shaped slot;

a pull lever pivotally mounted to said housing or said door, said pull lever having a pin received within said L-shaped slot; and a link having one end pivotally connected to said pull lever and an opposite end slidingly connected to said bell crank, said pull lever slidingly engages said handle between a lock position wherein said pull lever slides relative to said handle and an unlocked position wherein said pull lever is coupled to said handle and handle movement is translated to said pull lever.

4. A handle assembly as claimed in claim 3, wherein said handle is mounted on a common axis with said pull lever.

5. A handle assembly as claimed in claim 4, wherein said bell crank has an arcuate slot and said link is received within said arcuate slot.

* * * * *